United States Patent [19]

Grimstad

[11] Patent Number: 4,688,274

[45] Date of Patent: Aug. 25, 1987

[54] TOILET COVERING HINGE ASSEMBLY

[75] Inventor: Ronald N. Grimstad, Sheboygan, Wis.

[73] Assignee: Kohler Co., Kohler, Wis.

[21] Appl. No.: 806,295

[22] Filed: Dec. 6, 1985

[51] Int. Cl.[4] ..... A47K 13/12

[52] U.S. Cl. ..... 4/236; 4/240; 16/263; 16/381

[58] Field of Search ..... 4/236, 240; 16/386, 16/381, 262, 263

[56] References Cited

U.S. PATENT DOCUMENTS

| | | | |
|---|---|---|---|
| 465,839 | 12/1891 | Dearborn | 4/405 |
| 1,799,309 | 4/1931 | Mears | 4/236 |
| 2,064,628 | 12/1936 | Raflovich | 4/240 |
| 2,086,211 | 7/1937 | Campbell | 4/236 |
| 2,202,668 | 5/1940 | Moore | 4/236 |
| 3,471,874 | 10/1969 | Dixon | 4/240 |
| 3,526,907 | 9/1970 | Stairs | 4/236 |
| 3,550,164 | 12/1970 | Pease | 4/236 |
| 3,590,401 | 7/1971 | Brown | 4/236 |
| 3,670,441 | 6/1972 | Blount | 4/236 |
| 3,962,750 | 6/1976 | Buss et al. | 16/381 |
| 4,334,338 | 6/1982 | Conn | 16/266 |
| 4,342,124 | 8/1982 | Paredes | 4/236 |
| 4,438,535 | 3/1984 | Paredes | 4/236 |
| 4,561,130 | 12/1985 | Bumgardner et al. | 4/236 |
| 4,575,881 | 3/1986 | Rozek | 4/405 |

FOREIGN PATENT DOCUMENTS

| | | | |
|---|---|---|---|
| 0146651 | 12/1983 | European Pat. Off. . | |
| 1275207 | 2/1962 | France . | |
| 478405 | 2/1953 | Italy | 4/240 |
| 444915 | 3/1936 | United Kingdom | 16/386 |
| 910019 | 11/1962 | United Kingdom | 4/236 |

*Primary Examiner*—Stephen Marcus
*Assistant Examiner*—Linda J. Sholl
*Attorney, Agent, or Firm*—Quarles & Brady

[57] ABSTRACT

A hinge assembly for mounting a toilet covering member to the rear of a toilet so as to permit rotation of the covering about a hinge axis between an up and a down position is disclosed. In one form, a pair of hinge posts are mounted to the rear of the toilet which extend along a hinge axis. Each of a pair of hinge receiving elements are mounted to the toilet covering and has a bore which is alignable with one of the hinge post elements along the hinge axis. The hinge post elements have lugs axially spaced apart from stops and the bores in the hinge receiving elements are key hole shaped to permit a key and slot type connection between the hinge post elements and the hinge receiving elements. The toilet covering member is captured on the toilet by axially inserting the hinge post elements into the corresponding bores and rotating the hinge post elements relative to the hinge receiving elements about the hinge axis to lock the elements together. In one embodiment, the hinge post elements extend in the same direction and are fixed. In another embodiment, they extend in opposite directions and are axially slidable relative to one another.

8 Claims, 27 Drawing Figures

14
26
20
27
28
37
34
10
25
48
47
54
55
18
40
16
60
58
56
22
12
23

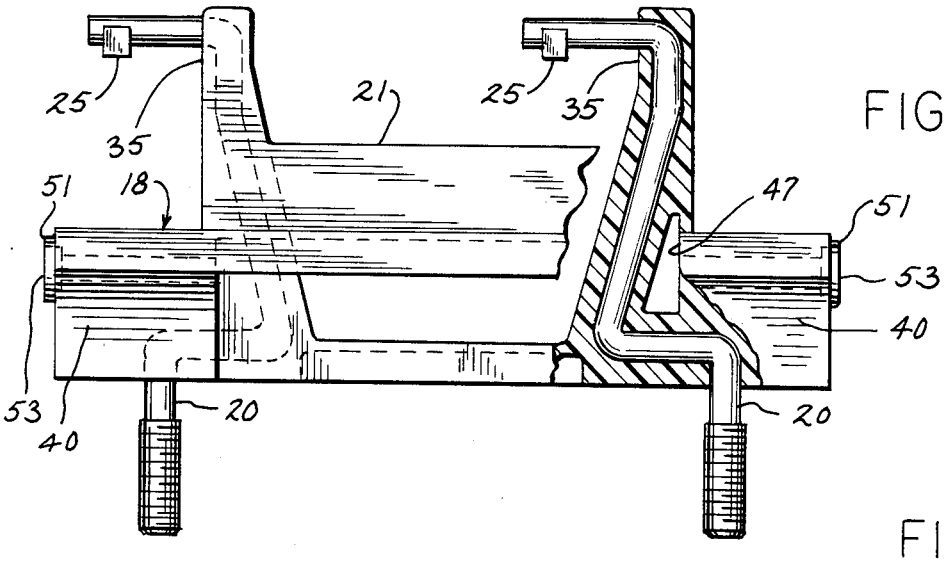
FIG. 5
FIG. 8
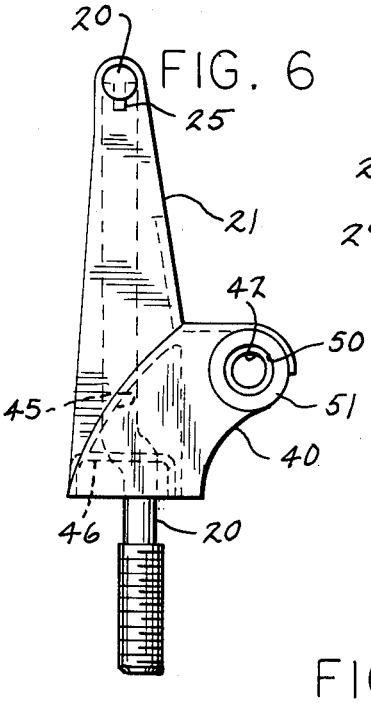
FIG. 6
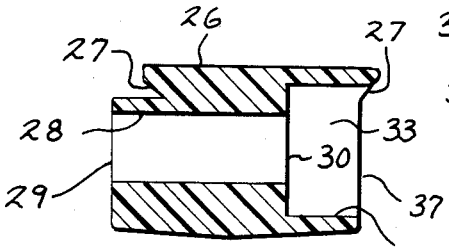
FIG. 11
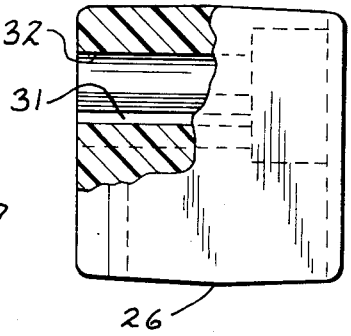
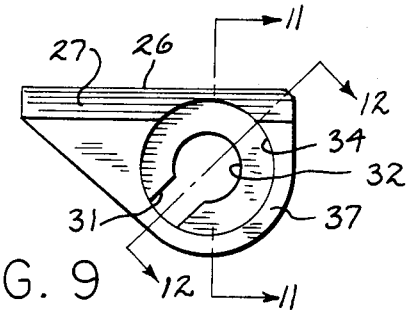
FIG. 9
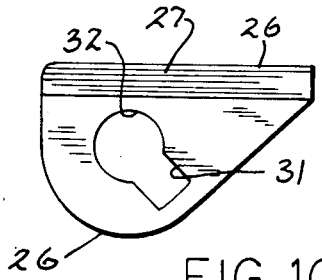
FIG. 10
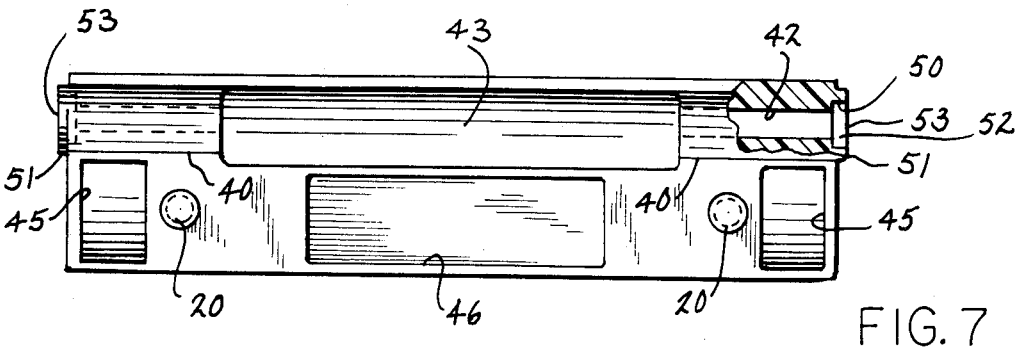
FIG. 7

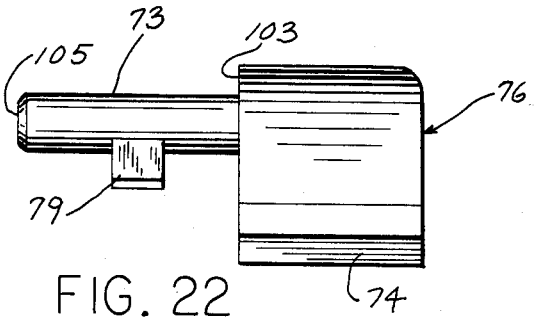
FIG. 22
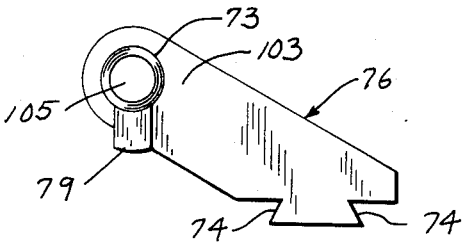
FIG. 23
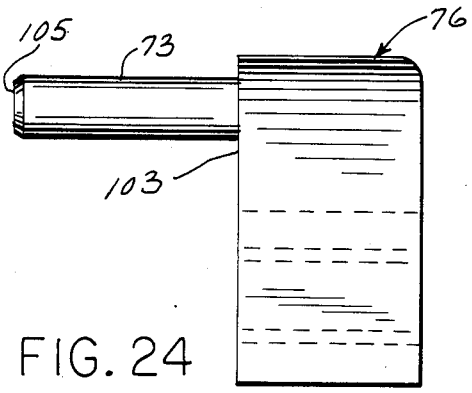
FIG. 24
FIG. 25
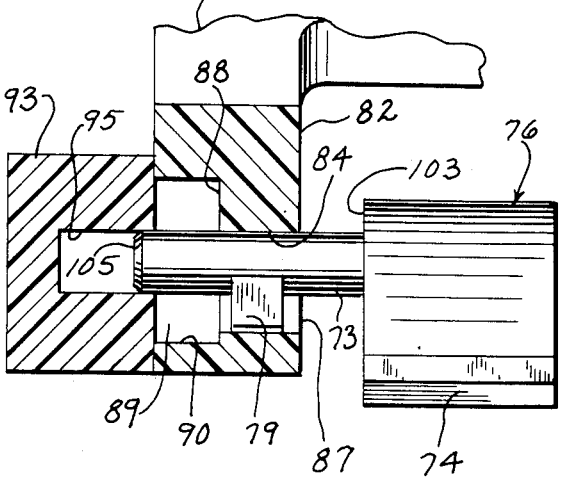
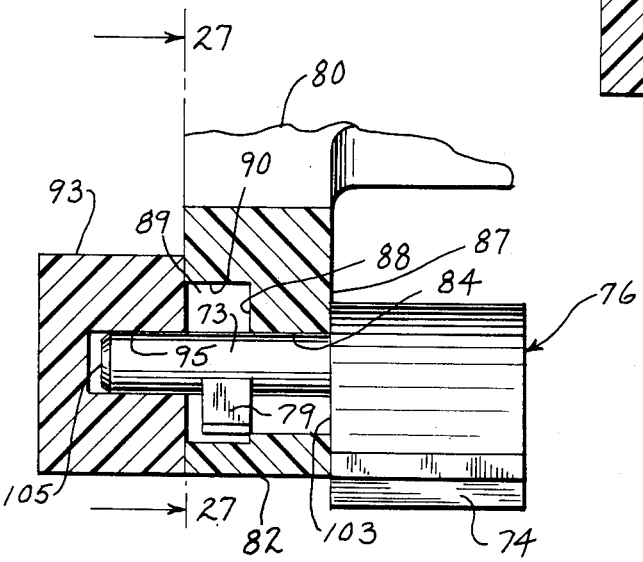
FIG. 26
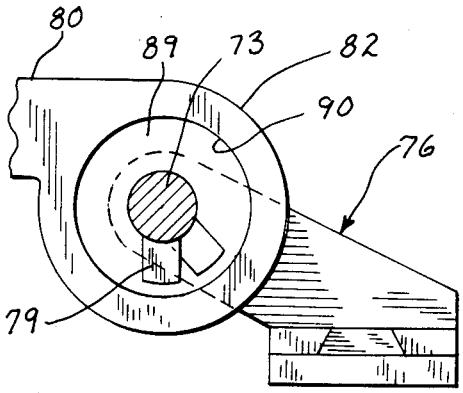
FIG. 27

TOILET COVERING HINGE ASSEMBLY

BACKGROUND OF THE INVENTION

1. Field of the Invention

This invention relates to hinges for mounting toilet basin covering members (e.g. toilet seats, toilet covers) to toilets.

2. Description of the Prior Art

Various types of toilet covering hinge assemblies are known. In designing such assemblies, one must keep in mind the difficulty of cleaning toilets (particularly in the area of the hinge assembly) and the high labor cost of assembling seats with toilets on an assembly line. These factors have made a hinge assembly which allows easy removal and installation of the toilet covering from the toilet desirable. It is also desirable that such hinge assemblies secure the toilet covering on the toilet without excessive looseness or play in the hinge joint, and that the toilet covering not be susceptible to accidental dismounting.

Modern toilet designs have placed still other new demands on toilet covering hinge assemblies. Modern toilets have become smaller and more streamlined. The hinge assembly must therefore fit into a smaller space than in prior toilets and in some cases must permit the toilet cover to be elevated at the rear. Further, in some applications the rear of the toilet seat may also be spaced substantially lower than the toilet cover.

It is also desirable that the connection between the toilet coverings and the toilet be hidden or nonvisible (at least to some extent) in the most common positions of the user relative to the toilet. Such a hidden connection also makes the method of disassembly less obvious to help prevent tampering with the toilet covering.

Therefore, it will be appreciated that a need exists for an improved toilet covering hinge assembly which provides for easy installation and removal of toilet coverings, provides a secure connection not susceptible to accidental removal between the toilet covering and the toilet, and is hidden and usable with modern toilet designs.

SUMMARY OF THE INVENTION

In one form, the invention provides a hinge assembly for mounting a toilet covering member to the rear of a toilet so as to permit rotation of the covering about a hinge axis between an up and a down position. A hinge receiving element has a bore which is alignable with the hinge axis and a hinge post element is insertable along the hinge axis into the bore. One of these elements is suitable to be connected to the rearward portion of the toilet, and the other of the elements is suitable to be connected to the rearward portion of the covering member. The elements and bore are fashioned so as to permit a key and slot type connection between the elements, whereby capture of the toilet covering member on the toilet may be achieved by axially inserting the hinge post element into the bore and rotating the elements relative to one another about the hinge axis to lock the elements together. This construction results in easy assembly and disassembly of the toilet covering member without excessive looseness in the hinge joint.

In a preferred form, a plurality of hinge receiving and hinge post elements are provided and each such hinge post element is insertable along the hinge axis into the corresponding hinge receiving element. The assembly position is designed to be between the up and down positions. Since the assembly position is only mementarily passed with the toilet covering is rotated between the up and down positions, and it would require an axial force at that position to dislodge the covering. This arrangement minimizes the chance that the toilet covering could become accidentally dislodged from the toilet.

In another aspect, each key and slot connection is formed by each bore being keyhole shaped and each hinge post element extending along the hinge axis from a stop to a lug which projects radially from the hinge post element. The hinge receiving element is trapped between the lug and the stop when the connection is made. A reserved space can also be formed in each hinge receiving element to house the corresponding lug as the hinge element rotates on the hinge post. The reserved space shields the lug and slot from view by a user and also provides a bearing surface at the adjacent end of the hinge receiving element.

In another aspect of the invention, a pair of hinge post elements and corresponding hinge receiving elements are provided. The hinge post elements extend in the same direction, with each hinge post being fixed relative to the other. One pair of the elements are suitable to be connected to the rearward portion of the toilet, and the other pair is suitable to be connected to the rearward portion of the covering member. The fixed hinge posts provide a rigid structure which can extend relatively far above the toilet to mount a toilet covering which is raised at the rear.

In another aspect, a base is securable to the rear of the toilet and both hinge post elements are fixed against movement relative to one another on the base. The hinge elements are then connectable to the rearward portion of the first covering member.

The base can also be provided with a pair of hinge block portions at opposite side ends. Each hinge block portion has a through-bore which extends from an inner end to an outer end with the through-bores being coaxial along a second axis (which is at a height lower than the first axis). A second covering member has a pair of rearward ears which are spaced apart to straddle the hinge block portions with a reserved space between each ear and the adjacent block portion. Each ear has a bore which opens inwardly and is alignable with the second axis so that a pair of hinge pins can be inserted through the hinge block portions into the adjacent ears to capture the second covering member axially on the toilet. Each hinge pin has at least one radially projecting catch which is compressed in the throughbore and expanded in the reserved space to hold the pin in position. In this aspect, a preferred pin has a slot formed in the area of each catch so that the pin is compressible and the outer end of the pin extends past the outer end of the slot to close off the slot.

In another aspect of the invention, a pair of hinge posts and corresponding hinge elements are provided, with each hinge post extending outwardly away from the other. At least one of the hinge post is axially slidable relative to the other. When both hinge post-hinge element pairs are assembled, the toilet covering and the slidable hinge post are captured on the toilet.

In an especially preferred form of this aspect, each hinge post is extendable into a blind bore of an adjacent hinge extension portion of a second covering member to capture the second covering member axially. Therefore, this aspect of the invention is especially adapted for providing a hinge assembly in which two toilet covering members are easily installed and removed from the toilet. This connection can also be made completely hidden from view by providing a reserved space in the hinge element to house the lug of the hinge post.

The present invention provides a savings in time and an improvement in convenience over existing toilet covering hinge assemblies. The resulting toilet covering hinge assemblies are easily and quickly assembled and disassembled. Furthermore, a toilet covering hinge assembly of the invention is adaptable to being very rigid and providing a different axis for each of two different toilet coverings or in providing a single axis for two coverings, each of which are easily removable. Furthermore, hinge assemblies of the invention can be made hidden from users to help prevent tampering with the hinge assembly.

It is therefore a principal object of the invention to provide a toilet covering hinge assembly which is easily and quickly assembled and disassembled.

It is another object of the invention to provide a toilet covering hinge assembly which enables facile cleaning of the toilet in the hinge assembly area.

It is another object of the invention to provide a toilet covering hinge assembly which is suitable to extend relatively far above a toilet to elevate the rear of a toilet covering.

It is another object of the invention to provide a toilet covering hinge assembly which deters tampering.

It is another object of the invention to provide a toilet covering hinge assembly which is not susceptible to accidental dismounting of the toilet coverings.

The foregoing and other objects and advantages of the invention will appear in the following detailed description. In the description, reference is made to the accompanying drawings which show, by way of illustration and not limitation, a preferred embodiment of the invention.

DESCRIPTION OF THE DRAWINGS

FIG. 5 is a front elevational view of the base of FIG. 4, shown with a portion broken away;

FIG. 6 is a side elevational view of the base of FIG. 4;

FIG. 7 is a bottom plan view of the base of FIG. 4;

FIG. 8 is a top plan view with a portion broken away, of a hinge element for the assembly of FIG. 3;

FIG. 9 is a side elevational view of the locking end of the hinge element of FIG. 8;

FIG. 10 is a side elevational view of the insert end of the hinge element of FIG. 8;

FIG. 11 is a sectional view taken along the line 11—11 of FIG. 9;

FIG. 22 is a rear elevational view of a carriage for the assembly of FIG. 17;

FIG. 23 is a left side elevational view of the carriage of FIG. 22;

FIG. 24 is a top plan view of the carriage of FIG. 22;

FIG. 25 is a sectional view taken along line 25—25 of FIG. 17 showing the carriage partially inserted into a toilet cover and seat which have been properly aligned;

FIG. 26 is a view similar to FIG. 25 showing the carriage fully inserted into the toilet cover and seat; and FIGQ 27 is a sectional view taken along line 27—27 of FIG. 26 showing the carriage locked to the toilet cover and seat.

DETAILED DESCRIPTION OF THE PREFERRED EMBODIMENTS

Figure 1:
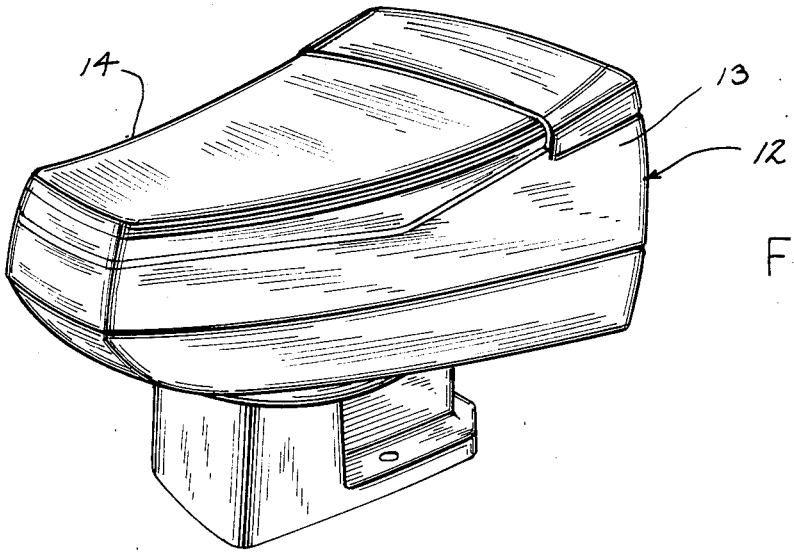
FIG. 1 is a perspective view of a toilet which is shown with both toilet coverings in the down position.
Figure 2:
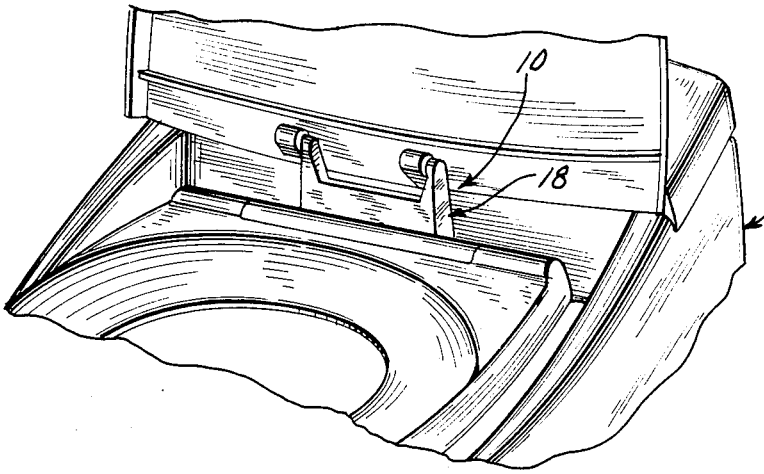
FIG. 2 is a perspective view of a portion of the toilet of FIG. 1 shown with the toilet cover in an up position and the toilet seat in the down position.

Referring to FIGS. 1 and 2, a toilet covering hinge assembly 10 of the invention is shown mounted to the rear of a toilet 12. The toilet 12 shown is a low profile streamlined toilet which slopes downwardly from the rear tank area 13 to the front. As can be seen in FIG. 1, the hinge assembly 10 is not visible with the toilet coverings in the normal down position. This is important to preserve the characteristic appearance of this streamlined toilet.

Referring to FIG. 2, the hinge assembly 10 includes two toilet covering members; a toilet cover 14 and a toilet seat 16. Both the cover 14 and the seat 16 are hingedly connected to a single hinge base 18 (FIGS. 4–7). In the preferred embodiment, the hinge base 18 includes a pair of brass hinge posts 20 and a body 21. The body 21 is made of a moldable material such as plastic. The hinge posts 20 are placed in a mold and the body is then molded around them to make the base 18. By molding the posts 20 in the body 21, the posts 20 are permanently fixed relative to one another and also rigidified for mounting the rear of the toilet cover 14 in an elevated position.

The hinge posts 20 are formed to enable them to be aligned with holes 22 (FIG. 3) which are provided at the rear of the toilet 12. The lower end of each post 20 extends beyond the body 21 far enough to extend through one of the holes 22 and is threaded. A pair of nuts 23 can then be screwed onto the ends of the hinge posts 20 beneath the holes 22 to securely fix the base 18 to the toilet 12.

The upper end of each hinge post 20 is formed to be horizontal and coaxial with the other hinge post 20 along a first axis. A portion of each hinge post 20 adjacent to the end has a lug 25 which projects radially from the hinge post. In the preferred embodiment, the angular orientation of the lug 25 on each hinge post 20 is the same as that of the lug 25 on the other hinge post 20 (both extend downwardly).

Figure 3:
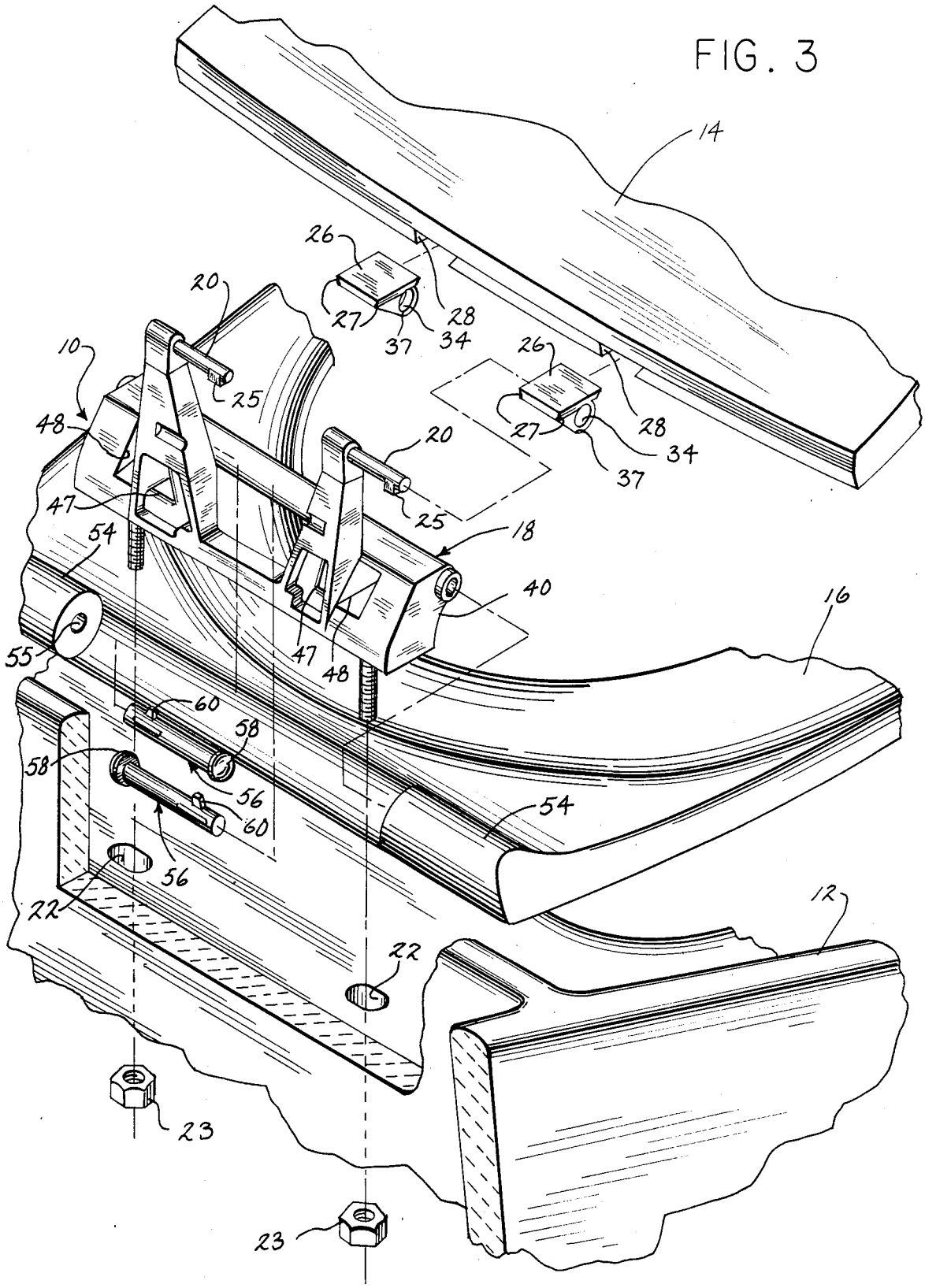
FIG. 3 is a rear exploded perspective view of the toilet and toilet coverings of FIGS. 1 and 2, together with a hinge assembly of the present invention.

The hinge assembly 10 also includes a pair of hinge elements 26 which are mounted to the underside of the cover 14. As shown in FIG. 3, the hinge elements 26 can be mounted to the cover 14 by a dovetail connection in which angled sides 27 of the hinge elements are slid into corresponding trackways 28 in the cover 14. The hinge elements 26 are then adhesively or otherwise secured in the trackways 28. Alternatively, the hinge elements 26 could also be integrally molded or formed in the cover 14.

Referring to FIGS. 8–11, each hinge element 26 has a through-bore 28 which extends from an insert end 29 to a locking end 30. Each through-bore 28 is keyhole-shaped, having a slot portion 31 and a circular portion 32, to closely receive one of the hinge posts 20, including the lugs 25, in an assembly position where the lugs 25 and slots 31 are in registration with one another. The locking end 30 opens into a reserved space 33 which is defined by a counterbore 34. The ends of the counterbores 34 provide bearing surfaces 37.

Figure 12:
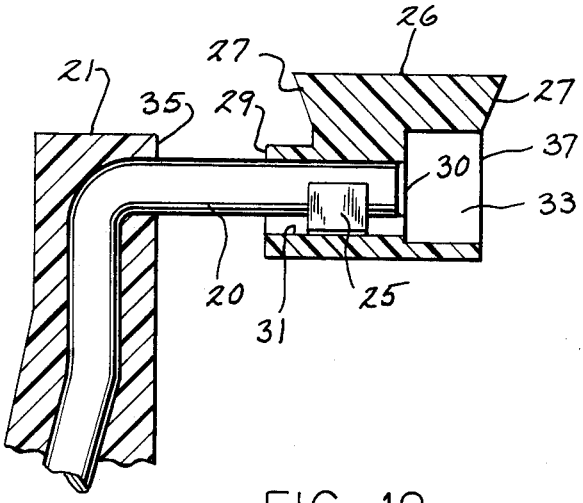
FIG. 12 is a sectional view taken along the line 12—12 of FIG. 9 and showing a hinge post of the base partially inserted into the hinge element.
Figure 13:
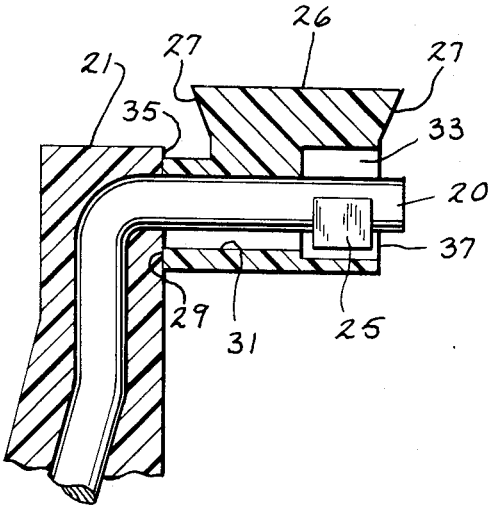
FIG. 13 is a sectional view similar to FIG. 12 showing the hinge post fully inserted into the hinge element.

The covering 14 is assembled to the base 18 by first aligning the through-bores 28 along the first axis with the insert ends 29 adjacent to the ends of the corresponding hinge posts 20. The slots 31 of the through-bores 28 are then angularly aligned into registration with the lugs 25 of the posts 20 (cover is 45° relative to horizontal) and the hinge elements 26 are slid onto the posts 20 (FIG. 12). As shown in FIG. 13, the axial insertion of the hinge posts 20 into the hinge elements 26 is stopped when the insert ends 29 of the hinge elements 26 abut stop means 35 of the body 21. In this position, each lug 25 is past the locking end 30 of the corresponding through-bore 28 and is positioned in the reserved space 33.

Figure 14:
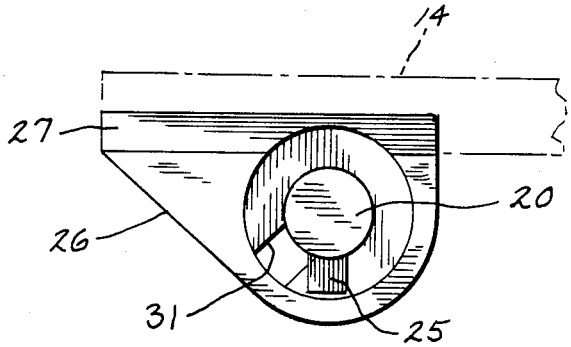
FIG. 14 is a side plan view similar to FIG. 9 but showing the hinge post locked to the hinge element.

The cover 14 can then be rotated downwardly or upwardly and the lugs 25 will become misaligned from the respective slots 31, thereby capturing the hinge element 26 between the stop means 35 and the lug 25. This locks the cover 14 axially relative to the base 18 (FIG. 14). The cover 14 is removed from the base 18 by repositioning the slots 31 and lugs 25 into angular registration in the 45° assembly positions, and then axially sliding the cover 16 away from the stop means 35.

With the lugs 25 and slots 31 not aligned, the cover 14 is free to rotate about the first axis but is axially captured with respect to the base 18. In the preferred embodiments, the assembly position (the angular position where the lugs 25 and slots 31 are aligned) is not at the up position or at the down position, but is between the up and down positions. Therefore, the assembly position will only be passed momentarily as the cover is rotated between the up and down positions. This minimizes the possibility of the cover 14 becoming accidentally dismounted from the toilet.

Also, it is preferred to have the lugs 25 angularly aligned with one another and the slots 31 angularly aligned with one another. This way, the hinge posts 20 are interchangeable with one another and the hinge elements 26 are interchangeable with one another. Also, two hinge posts 20 and a corresponding number of hinge elements 26 are preferred for sufficient stability, although applications may exist for only one hinge post and element or for more than two. Another possible variation of the invention is that the hinge posts 20 could be fixed to the cover 14 and the hinge elements 26 fixed to the base 18.

This aspect of the invention provides a toilet covering hinge assembly which enables fast and easy removal of a toilet covering to facilitate manufacturing and cleaning. However, the hinge assembly still provides a secure connection between the toilet covering and the toilet which is not susceptible to accidental release. Moreover, the connection between the hinge posts and hinge elements is hidden from normal users to improve aesthetics and deter tampering. This arrangement also allows for the cover 14 to be raised at the rear.

The hinge assembly 10 also connects the seat 16 to the toilet 12. The seat 16 is hingedly connected to the base 18 for rotation about a second axis between a down and an up position. The second axis is parallel to the first axis and is at a height lower than the first axis.

Figure 4:
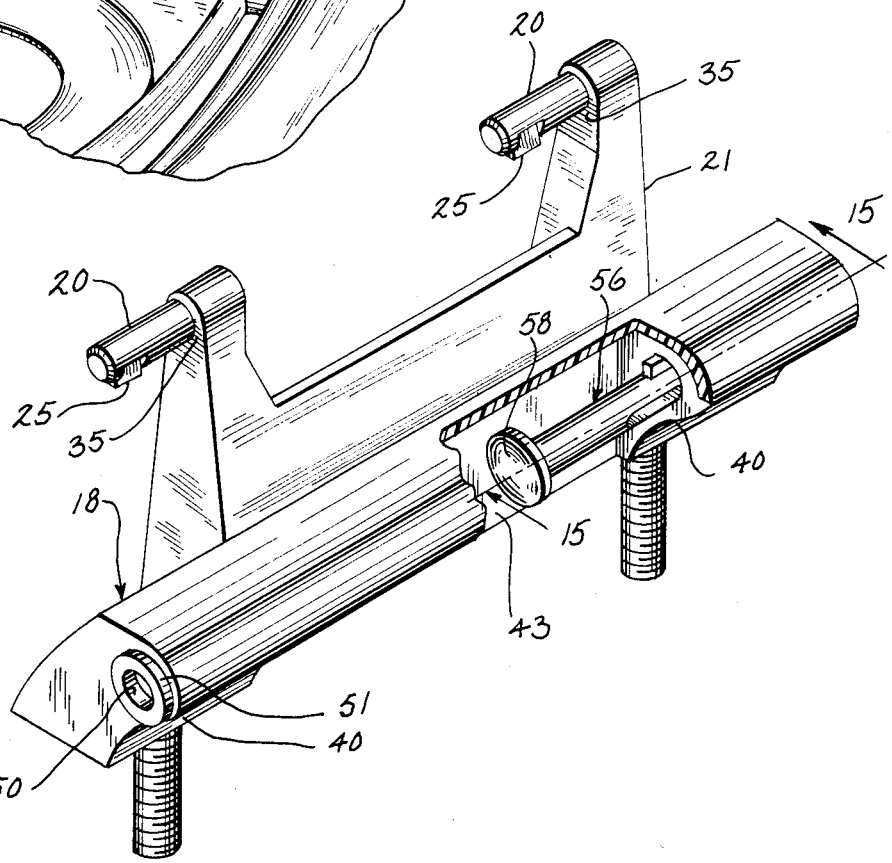
FIG. 4 is a frontal perspective view of a base for the assembly of FIG. 3 shown with a portion broken away and with a pin partially inserted.

To provide a hinge connection for the seat 16, the base 18 has a hinge block portion 40 at each of its ends. Each hinge block portion 40 has a through-bore 42 which is coaxial with the through-bore 42 of the other portion 40 along the second axis. As best shown in FIGS. 4 and 7, the inward ends of the through-bores 42 are accessible by means of a recess 43 in the base 18. Other recesses 45, 46, 47 and 48 are also provided in the base 18 to save plastic material. Adjacent to the outer ends of the bore 42 are counter-bores 50. The counterbores 50 are surrounded by a raised circular rib 51, to define a reserved space 52. The outer surface of the raised rib 51 provides a bearing surface 53.

The seat 16 has a pair of ears 54 which are adapted to straddle the hinge block portions 40. Each each 54 has a blind bore 55 which opens inwardly and is adapted to be axially aligned with the second axis.

The seat 16 is assembled to the base 18 using pins 56. Referring to FIGS. 3, 4, 15 and 16, each pin 56 has a head 58 at an inner end and a pair of catched 60 which project radially from the pin and are spaced a distance axially away from the head 58. An outer end 62 of each pin 56 is spaced a distance from the catches 60 opposite from the head 58. Between the catches 60, each pin 56 has a through-slot 64. Since each pin 56 is made of a flexible plastic material, the slot 64 enables the pin 56 to be compressed radially in the area of the catches 60. The end 62 is beyond the slot 64 to close off the outer end of the slot 64.

Figure 15:
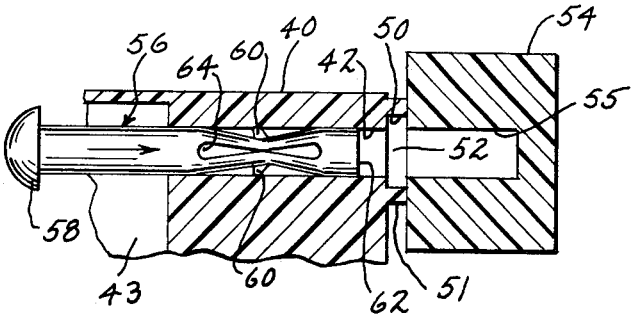
FIG. 15 is a sectional view taken along line 15—15 of FIG. 4 showing the hinge pin further inserted into the hinge base and with the toilet seat aligned with the hinge base.
Figure 16:
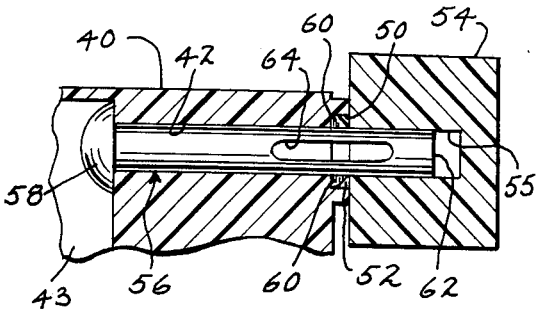
FIG. 16 is a sectional view similar to FIG. 15 showing the hinge pin fully inserted into the hinge base and toilet seat.

To attach the seat 16 to the base 18, each pin 56 is inserted from inward to outward into one of the block portion through-bores 42, access being had to the inner ends of the through-bores 42 by means of the recess 43. The outer sides of the catches 60 are inclined so that the catches 60 enter the through-bores 42, the pins 56 are compressed as shown in FIG. 15. Before the outer end 62 of each pin 56 reaches the outer end of the reserved space 52, the blind bores 55 of the ears 54 are axially aligned with the through-bores 42 along the second axis. Each pin 56 is then pressed all the way into the respective through-bore 42 until its head 58 abuts the base 18. In this position, the catches 60 are past the outer end of the through-bores 42 and are positioned and expanded in the respective reserved spaces 52 (FIG. 16). The inward sides of the catches 60 are squared off to hold the pins within the through-bores 42 and the portion of each pin 56 adjacent to the outer end 62 is in the blind bore 55 of the adjacent ear 54 to hold the seat 16 axially relative to the base 18, but to allow it to be rotated between the up and down positions.

The connection of the seat 16 is very fast and easy to make but is not easily dismantled. This does not cause a problem with cleaning since removing the cover 14 normally provides sufficient access even with the seat in place. Also, the connection of the seat 16 to the base 18 is hidden from the normal user.

Figure 17:
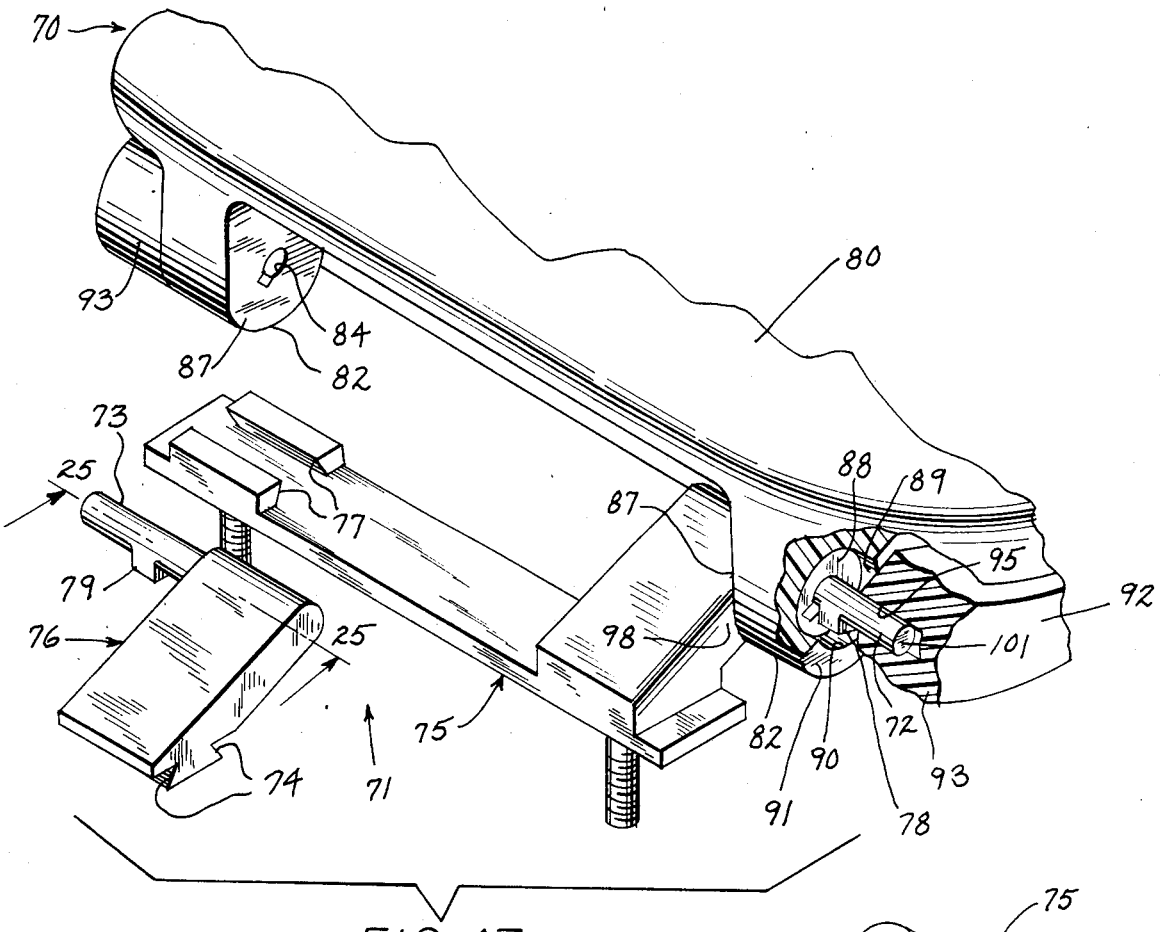
FIG. 17 is an exploded perspective view with portions broken away of a second embodiment of a toilet covering hinge assembly of the invention.
Figure 18:
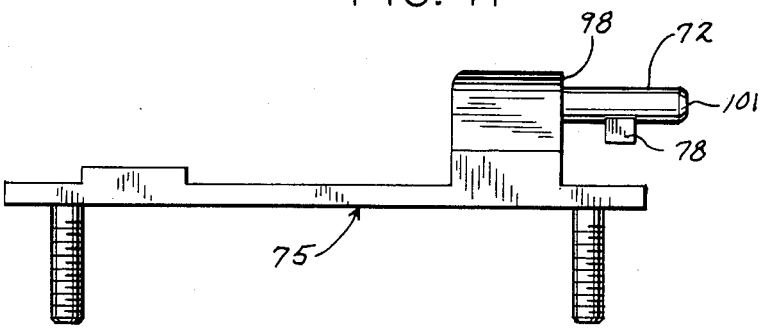
FIG. 18 is a rear elevational view of a foundation for the assembly of FIG. 17.
Figure 20:
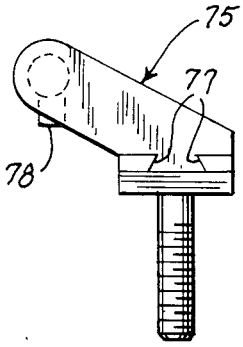
FIG. 20 is a left side elevational view of the foundation of FIG. 18.
Figure 19:
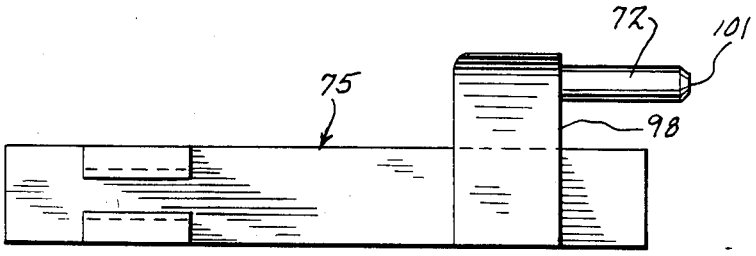
FIG. 19 is a top plan view of the foundation of FIG. 18.
Figure 21:
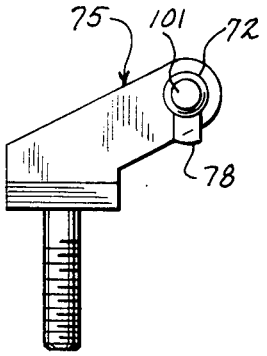
FIG. 21 is a right side elevational view of the foundation of FIG. 18.

For applications where it is desirable to have a hidden connection and where it is easy to remove both the cover and the seat, a second embodiment 70 of a toilet covering hinge assembly of the invention is illustrated in FIG. 17. In this embodiment, a hinge base 71 includes a foundation 75 and a carriage 76. Two hinge posts 72 and 73 face away from one another and are coaxial along a single axis. The hinge post 72 is fixed to the foundation 75 and the foundation is secured to the rear of a toilet basin with nuts (not shown) as was the base 18.

The other hinge post 73 is formed integral with the carriage 76. The carriage 76 is mounted to the foundation 75 by a dovetail connection, having angled edges 74 which fit into corresponding trackways 77 in the foundation 75. This connection enables sliding the hinge post 73 along the first axis without rotation of the hinge post 73 and without lateral movement of the hinge post 73 (lateral being defined as the directions radial to the hinge axis). As in the first embodiment, the hinge posts 72 and 73 have lugs 78 and 79, respectively, which project radially from the hinge posts.

A toilet cover 80 has integrally formed hinge elements 82. Each hinge element 82 has a through-bore 84 which is a non-circular, keyhole-shape, having a slot portion and a circular portion, to closely receive one of the posts 72 and 73. Each through-bore 84 extends from an insert end 87 to an outer locking end 88. Each locking end 88 opens into a reserved space 89 which is defined by a counter-bore 90. The outer face of the counter-bore 90 provides a bearing surface 91.

A toilet seat 92 has ears 93 which are adapted to straddle the hinge elements 82. Each ear 93 has a blind bore 95 which opens inwardly and is adapted to be axially aligned with the first axis.

The toilet cover 80 and seat 92 are assembled to the base 71 by first straddling the ears 93 on the outside of the hinge elements 82 with the through-bores 84 and 95 aligned along the first axis. The slot of the right side (as viewed in FIG. 17) through-bore 84 is then positioned in angular registration in an assembly position with the lug 78 of the post 72. The right side hinge element 87 and ear 93 are then slid onto the post 72 until the insert end 87 abuts an outer stop face 98 of the foundation 75. In this position, the lug 78 is past the locking end 88 and is positioned in the reserved space 89. Also, an outer end 101 of the post 72 extends past the lug 78 and is received within the blind bore 95 of the adjacent ear 93.

The left (as viewed in FIG. 17) through-bores 84 and 95 are then aligned along the first axis with the post 73. The slot of the left through-bore 84 is angularly aligned with the lug 79 and the carriage 76 is slid into the trackways 77, with the post 73 entering the through-bore 84, (FIG. 25) until an outer face 103 of the carriage 76 abuts the insert end 87 (FIG. 26). As for the left hinge connection, in this position the lug 79 is past the locking end 88 of the left hinge element 82 and is positioned in the reserved space 89. Also, an outer end 105 of the post 73 extends into the blind bore 95 of the left hinge extension portion 93.

This hinge assembly locks the toilet cover 80 and toilet seat 92 axially on the base 71 when the lugs and corresponding slots are not in registration with one another as shown in FIG. 17 for the right lug/slot pair and in FIG. 27 for the left lug/slot pair. At the same time, the left hinge post 73 is locked axially, rotationally, and laterally on the toilet. However, the cover 80 and seat 92 are free to rotate about the hinge axis, either together or independently of one another.

The lugs 78 and 79 are corresponding slots need not all be angularly aligned with one another, as they are in the preferred embodiment, although each lug/slot pair must be angularly alignable in some position. Note that the position for each pair need not be the same as for the other pair. If it is not the same, the cover 80 will have to be rotated after assembling the right lug/slot pair to angularly align the left lug/slot pair.

This aspect of the invention provides a toilet covering hinge assembly which allows facile assembly and removal of both a toilet cover and a toilet seat. Both connections are secure, with negligible radial and axial looseness, and are not susceptible to accidental dismounting. Both connections are also hidden from view for appearance and to deter tampering.

Numerous modifications and variations in addition to those mentioned above will be apparent to those of ordinary skill in the art without departing from the spirit or scope of the invention. For example, hinge posts 72 and 73 could be slidably mounted relative to one another on the toilet cover 80 and stationary hinge elements 80 could be fixed to the toilet, with the ears of the seat straddling the hinge elements. Also in the second embodiment, the hinge elements could be formed on the seat and the ears formed on the cover. Therefore, the invention is not intended to be limited by the description or drawings of the preferred embodiments, but only by the claims which follow.

We claim:

1. A hinge assembly for mounting a first covering member to the rear of a toilet for rotation of the covering about a first axis between an up and a down position, comprising:

a pair of spaced-apart hinge receiving elements, each of said hinge receiving elements having a bore which is alignable with the first axis;

a pair of hinge post elements extending in the same direction, one corresponding to each hinge receiving element, each of said hinge post elements being fixed relative to the other and being insertable along the first axis into the bore of the corresponding hinge receiving element;

two of said elements being suitable to be connected to the rearward portion of the toilet, and the other two of said elements being suitable to be connected to the rearward portion of the covering member; and said elements and bores being fashioned so as to permit a key and a slot type connection between at least one hinge post element and a corresponding hinge receiving element, whereby capture of the toilet covering member on the toilet may be achieved by axially inserting the hinge post elements in the corresponding bores and rotating the covering member relative to the toilet about the hinge axis, thereby locking the elements together;

wherein each such hinge post element is insertable along the hinge axis into the corresponding hinge receiving element in a normal assembly position of the covering member, said normal assembly position being between the up and down positions of the covering member.

2. A hinge assembly as in claim 1, further comprising a base which is securable to the rear of the toilet and wherein both hinge post elements are fixed against movement relative to each other on the base and the hinge receiving elements are connectable to the rearward portion of the first covering member.

3. A hinge assembly as in claim 2, further comprising;

a pair of hinge block portions at opposite side ends of the base, each of said portions having a through-bore which extends from an inner end to an outer end, said through-bores being coaxial along a second axis which is at a height lower than the first axis;

a second covering member having a pair of rearward ears which are spaced apart to straddle the hinge block portions with a reserved space between each ear and the adjacent block portion, each said ear having a bore which opens inwardly and is alignable with the second axis; and a pair of hinge pins, each said hinge pin having at least one radially projecting catch and being insertable into a corresponding one of the through-bores from the inner end to the outer end;

wherein each catch is compressed in the through-bore and expanded in the reserved space to hold the pin in position and the outer end of the pin extends into the bore of the adjacent ear to capture the second covering member axially on the toilet.

4. A hinge assembly as in claim 3, wherein the reserved space in formed in the base to house the catch.

5. A hinge assembly as in claim 3, wherein a slot is formed in each pin in the area of each catch, and the outer end of the pin extends past the outer end of the slot to close off the slot.

6. A hinge assembly for mounting a first covering member to the rear of a toilet for rotation of the covering about a first axis between an up and down position, comprising:

a pair of spaced-apart hinge receiving elements, each of said hinge receiving elements having a bore which is alignable with the first axis;

a pair of hinge post elements extending in the same direction, one corresponding to each hinge receiving element, each of said hinge post elements being fixed relative to the other and being insertable along the first axis into the bore of the corresponding hinge receiving element;

two of said elements being suitable to be connected to the rearward portion of the toilet, and the other two of said elements being suitable to be connected to the rearward portion of the covering member;

said elements and bores being fashioned so as to permit a key and slot type connection between at least one hinge post element and a corresponding hinge receiving element, whereby capture of the toilet covering member on the toilet may be achieved by axially inserting the hinge post elements in the corresponding bores and rotating the hinge post elements relative to the hinge receiving elements about the hinge axis, thereby locking the elements together;

a base which is securable to the rear of the toilet and wherein both hinge post elements are fixed against movement relative to each other on the base and the hinge receiving elements are connectable to the rearward portion of the first covering member;

a pair of hinge block portions at opposite side ends of the base, each of said portions having a through-bore which extends from an inner end to an outer end, said through-bores being coaxial along a second axis which is at a height lower than the first axis;

a second covering member having a pair of rearward ears which are spaced apart to straddle the hinge block portions with a reserved space between each ear and the adjacent block portion, each said ear having a bore which opens inwardly and is alignable with the second axis; and a pair of hinge pins, each said hinge pin having at least one radially projecting catch and being insertable into a corresponding one of the through-bores from the inner end to the outer end;

wherein each catch is compressed in the through-bore and expanded in the reserved space to hold the pin in position and the outer end of the pin extends into the bore of the adjacent ear to capture the second covering member axially on the toilet.

7. A hinge assembly as in claim 6, wherein the reserved space is formed in the base to house the catch.

8. A hinge assembly as in claim 6, wherein a slot is formed in each pin in the area of each catch, and the outer end of the pin extends past the outer end of the slot to close off the slot.

* * * * *